US009088105B2

(12) United States Patent
Muro

(10) Patent No.: US 9,088,105 B2
(45) Date of Patent: Jul. 21, 2015

(54) SLIP-OUT PREVENTING CONNECTOR

(71) Applicant: YAZAKI CORPORATION, Tokyo (JP)

(72) Inventor: Takashi Muro, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 108 days.

(21) Appl. No.: 13/919,719

(22) Filed: Jun. 17, 2013

(65) Prior Publication Data

US 2013/0280941 A1 Oct. 24, 2013

Related U.S. Application Data

(63) Continuation of application No. PCT/JP2011/079656, filed on Dec. 21, 2011.

(30) Foreign Application Priority Data

Dec. 21, 2010 (JP) ..... 2010-285093

(51) Int. Cl.
*H01R 13/62* (2006.01)
*H01R 13/64* (2006.01)
*H01R 13/42* (2006.01)

(52) U.S. Cl.
CPC ..... *H01R 13/64* (2013.01); *H01R 13/42* (2013.01); *H01R 13/62* (2013.01)

(58) Field of Classification Search
USPC ..... 439/511, 512, 345, 502, 284, 952
See application file for complete search history.

(56) References Cited

U.S. PATENT DOCUMENTS

| | | | | |
|---|---|---|---|---|
| 5,496,188 | A * | 3/1996 | Okamura et al. | 439/189 |
| 5,556,301 | A * | 9/1996 | Chishima et al. | 439/507 |
| 7,241,168 | B2 * | 7/2007 | Sakurai et al. | 439/511 |
| 7,883,362 | B2 * | 2/2011 | Ichio et al. | 439/511 |
| 2001/0000498 | A1 * | 4/2001 | Watanabe et al. | 439/66 |
| 2001/0029124 | A1 * | 10/2001 | Hasegawa | 439/357 |

FOREIGN PATENT DOCUMENTS

| | | | |
|---|---|---|---|
| JP | 2001-14963 | A | 1/2001 |
| JP | 2004-14390 | A | 1/2004 |
| JP | 2009-146659 | A | 7/2009 |

OTHER PUBLICATIONS

International Search Report and Written Opinion of the International Search Report for PCT/JP2011/079656 dated Feb. 28, 2012.

* cited by examiner

*Primary Examiner* — Abdullah Riyami
*Assistant Examiner* — Harshad Patel
(74) *Attorney, Agent, or Firm* — Kenealy Vaidya LLP

(57) ABSTRACT

In the connector housing 10, a side wall opening 10W is formed which is continuous to an upper half of an opposite side wall 10S2 from the rear surface opening 10R. A tapered protrusion 10M is provided to stand upward from a lower side opening end face 10W1 of the side wall opening 10W. In the terminal 20, a tapered engaging recessed part 20M is formed in a part opposed to the tapered protrusion 10M. In one side wall 10S1 of the connector housing 10, a tapered hole 10K is formed. In the terminal 20, a tapered protrusion 20K is formed which enters the tapered hole 10K. Thus, the terminal 20 slides in a transverse direction by a sliding operation of the tapers so that the terminal 20 is held in the connector housing 10.

6 Claims, 7 Drawing Sheets

SLIP-OUT PREVENTING CONNECTOR

CROSS REFERENCE TO RELATED APPLICATION

This application is a continuation of PCT application No. PCT/JP2011/079656, which was filed on Dec. 21, 2011 based on Japanese Patent Application (No. 2010-285093) filed on Dec. 21, 2010, the contents of which are incorporated herein by reference. Also, all the references cited herein are incorporated as a whole.

BACKGROUND OF THE INVENTION

1. Field of the Invention

The present invention relates to a slip-out preventing connector, and more particularly to a connector having such a slip-out preventing function that even when a terminal is inserted, from a back side, into a PCB (a printed circuit board) and a JC (Joint connector) into which the terminal cannot be inserted from a front (an insert opening into which a mate side connector is inserted) side in view of its structure, a terminal holding force or an attaching property is not deteriorated.

2. Description of the Related Art

In an ordinary PCB (a printed circuit board) terminal, a male terminal is inserted from a front side (for instance, see JP-A-2009-146659).

Reasons thereof are described below.

(1) A resin is not desired to adhere to a contact part.

(2) An accuracy of a male and female contact point is more important than that of a lead to be soldered.

(3) When a tab slips out during an insertion of a female connector or when a wire harness is pulled after male and female connectors are fitted to each other, a holding force of a male housing and a male terminal is operated.

FIG. 8 shows a usual connector disclosed in the patent literature 1.

FIG. 8(A) is a perspective view of a connector housing. FIG. 8(B) is a horizontally sectional view of FIG. 8(A). FIG. 8(C) is a horizontally sectional view of a state that a terminal is inserted.

The connector housing 100 in FIG. 8(A) is a resin product provided with a terminal insert hole in an interior of a front as shown in FIG. 8(B). The terminal insert hole is formed as a hole wide in its front side and narrow in its interior side as shown below by a round enlarged view.

The terminal 200 has an insert part of a form corresponding to the terminal insert hole. When the terminal 200 is inserted into the terminal insert hole, since a sheared surface is sufficiently ensured in a direction A, the terminal is hardly pulled out in the direction A. However, a press-in margin is merely held in a direction B.

Accordingly, a male terminal is ordinarily inserted from the front side.

<Problem when Terminal Cannot be Inserted from Front Side>

Owing to the above-described reason, it is advantageous for the connector to attach the terminal from the front side. However, when the form of the terminal is larger in an opposite side to the contact part than the contact part, the terminal cannot be attached from the front side. Accordingly, the connector housing is inverted to insert the terminal from an opposite side to the front. In this case, as described in the reason of the above-described (3), since the terminal is pulled in the same side as a direction in which the terminal is inserted to the connector housing, a problem arises that the terminal is liable to slip out.

SUMMARY OF THE INVENTION

The present invention is devised to solve the above-described problem and it is an object of the present invention to provide a slip-out preventing connector having a connector housing and a terminal used therein which can improve a holding force of a terminal and an overhauling property even in a connector of a type that the terminal is inserted into the connector housing from an opposite side to an insert hole to which a mate side connector terminal is inserted.

The above-described object is achieved by below-described structures.

(1) A slip-out preventing connector includes a connector housing having an insert hole to which a mate side connector terminal is inserted and a rear surface opening as a terminal insert hole to which a terminal of its own is inserted and the terminal inserted from the rear surface opening and held therein. In the connector housing, a side wall opening is formed which is continuous to an intermediate part in an upper half of one side wall of the connector housing from the rear surface opening. A tapered protrusion is provided to stand upward from a lower side opening end face of the side wall opening. In a part of the terminal opposed to the tapered protrusion in the one side wall at a position where the terminal is held in the connector housing, a tapered engaging recessed part is formed which the tapered protrusion enters. In the other side wall opposite to the one side wall in the connector housing, a tapered hole is formed. In a part of the terminal opposed to the tapered hole of the other side wall at a position where the terminal is held in the connector housing, a tapered protrusion is formed which enters the tapered hole. The terminal slides in a direction at right angles to an inserting direction of the terminal due to an operation of the tapers to be held in the connector housing.

(2) In a slip-out preventing connector of the structure of the above-described (1), in the connector housing, a guide protruding part which extends in the inner space of the connector housing is formed from the one side wall having the side wall opening formed. The guide protruding part comes into contact with a pin of the terminal, and the tapered protrusion of the terminal comes into contact with an inner wall of the connector housing, so that the terminal is regulated and inserted.

According to the structure of the above-described (1), even in the connector of a type that the terminal is inserted from the opposite side to the insert hole to which the mate side connector terminal is inserted, since the terminal cannot be pulled out, a holding force can be improved. Further, in overhauling, since the connector can be simply overhauled by using a jig, an overhauling property can be improved.

According to the structure of the above-described (2), the terminal can be smoothly inserted into the connector housing.

DESCRIPTION OF THE PREFERRED EMBODIMENTS

Figure 1:
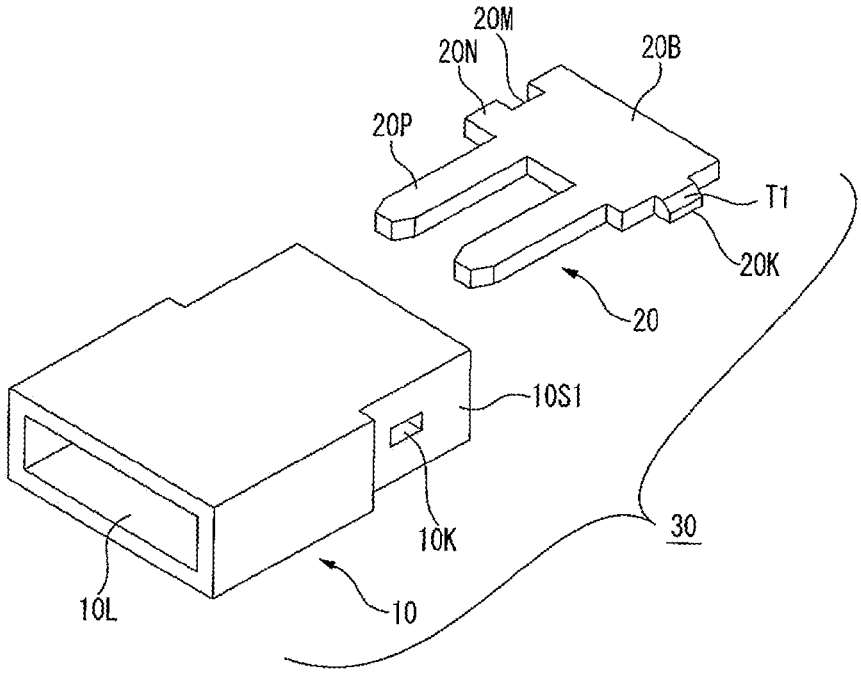
FIG. 1 is an exploded perspective view, which is seen from a front side of a connector housing, of a slip-out preventing connector according to one exemplary embodiment of the present invention which includes the connector housing and a terminal.

Now, a slip-out preventing connector which is a connector of a type that a terminal is inserted from an opposite side to an insert hole to which a mate side connector terminal is inserted, and can improve a holding force of the terminal and an overhauling property will be described below by referring to the drawings.

<Structure of Slip-Out Preventing Connector According to the Present Exemplary Embodiment>

In FIG. 1 to FIG. 7, a slip-out preventing connector 30 according to one exemplary embodiment of the present invention includes a connector housing 10 and a terminal 20 inserted into an inner space of the connector housing 10 from an opposite side of a front (an insert hole to which a mate side connector terminal is inserted) 10L of the connector housing 10.

Now, the connector housing 10 and the terminal 20 according to the one exemplary embodiment of the present invention will be described below.

<Structure of Connector Housing 10 According to the Present Exemplary Embodiment>

The connector housing 10 according to the present exemplary embodiment is a resin molded product having the front 10L (see FIG. 1) to which the mate side connector terminal is inserted. The terminal 20 (see FIG. 1) is inserted into the inner space of the connector housing 10 from a rear surface opening 10R (see FIG. 2) located in an opposite side to the front 10L.

Features of the connector housing 10 are described below.

Figure 2:
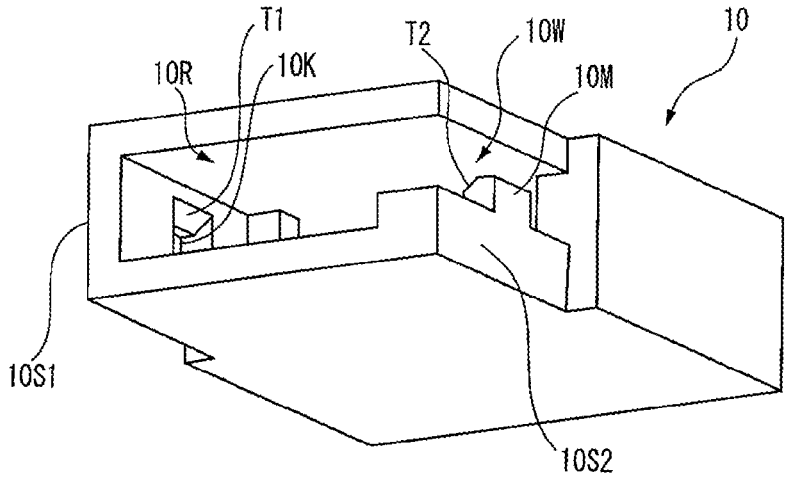
FIG. 2 is a perspective view of the connector housing shown in FIG. 1 seen from a lower part of the front side of the connector housing.
Figure 3A:
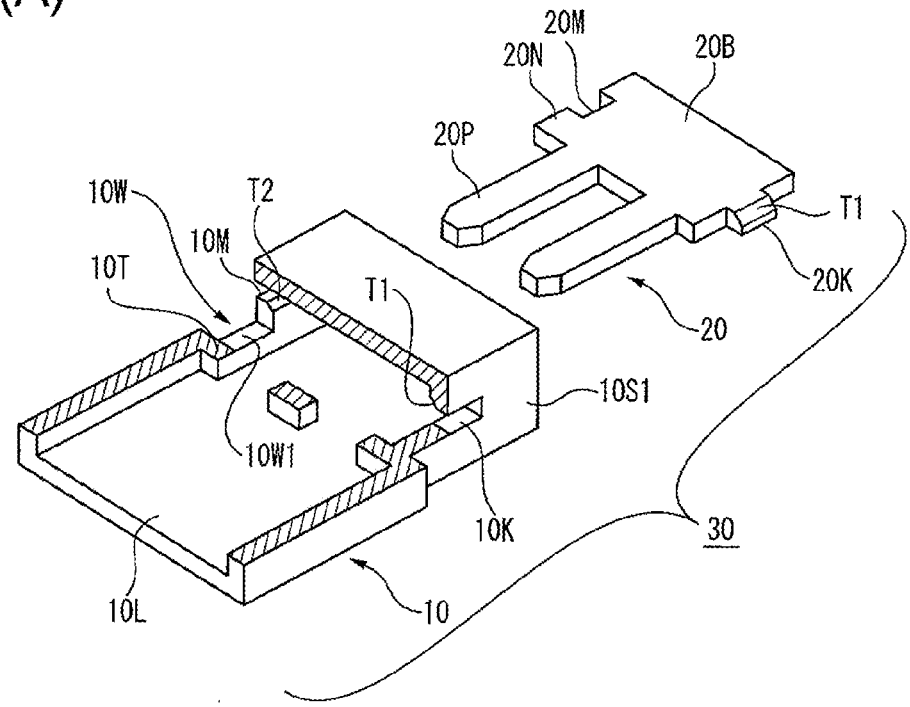
FIG. 3 (A) is an exploded perspective view of the slip-out preventing connector in a state shown in FIG. 1 which is seen under a state that the connector is partly broken.
FIG. 3(B) is an exploded perspective view showing an opposite side surface of the slip-out preventing connector of FIG. 3(A).

(1) A tapered hole 10K (FIG. 1, FIG. 2, FIG. 3(A)) is opened in one side wall (the other side wall) 10S1 (FIG. 1, FIG. 2, FIG. 3(A)).

(2) A tapered protrusion 10M (FIG. 3(B)) is provided upright in a lower side opening end face of a below-described side wall opening 10W of an opposite side wall (one side wall) 10S2 (FIG. 3(B)).

<Tapered Hole 10K According to the Present Exemplary Embodiment>

In FIG. 1, FIG. 2 and FIG. 3(A), the tapered hole 10K is opened in the one side wall 10S1. The tapered hole 10K is a rectangular hole and has such a size that a below-described tapered protrusion 20K (FIG. 1, FIG. 3(A)) may be inserted. In a part of thickness of the one side wall 10S1 forming an upper side of the rectangular form, a substantially semi-circular arc shaped protruding taper T1 is formed.

<Tapered Protrusion 10M According to the Present Exemplary Embodiment>

In FIG. 2, in the opposite side to the front 10L (see FIG. 1), the rear surface opening 10R is formed. An upper part of a wall surface of a right side is scooped out so that the rear surface opening 10R is further extended to the opposite side wall 10S2. Finally, the side wall opening 10W is formed in which about an upper half is opened to the latter half part of the opposite side wall 10S2. The tapered protrusion 10M is provided upright upward from the lower side opening end face 10W1 of the side wall opening 10W. The height of the tapered protrusion 10M corresponds to a thickness of the terminal 20 and the width corresponds to a width of a below described tapered engaging recessed part 20M of the terminal 20. Then, a substantially semi-circular arc shaped protruding taper T2 is formed downward in an inward direction from a top part of the tapered protrusion 10M.

Further, in the front 10L side from the tapered protrusion 10M of the opposite side wall 10S2, a tab side (a guide protruding part) 10T (see FIG. 5) is formed which extends in the inner space of the connector housing 10. A length thereof is set to a length that an end comes into contact with a male terminal (a pin) 20P of the terminal 20.

<Structure of Terminal 20 According to the Present Exemplary Embodiment>

The terminal 20 according to the present exemplary embodiment is a metal plate including a rectangular base part 20B and two male terminals 20P which are integrally extended toward the mate side connector terminal from the base part 20B and inserted into the mate side connector terminal (a female). In the terminal 20, the male terminals 20P are inserted into the inner space of the connector housing from the rear surface opening 10R (see FIG. 2) located in the opposite side to the front 10L of the connector housing 10. Finally, an entire part of the terminal 20 is inserted and fixed to the connector housing 10.

Features of the terminal 20 are described below.

(1) In a side (part) of the rectangular base part 20B opposed to the tapered hole 10K of the one side wall 10S1 (see FIG. 1) in a position where the terminal 20 is held in the connector housing 10, the tapered protrusion 20K (see FIG. 1 and FIG. 3(A)) is formed which enters the tapered hole 10K of the connector housing 10.

Figure 3B:
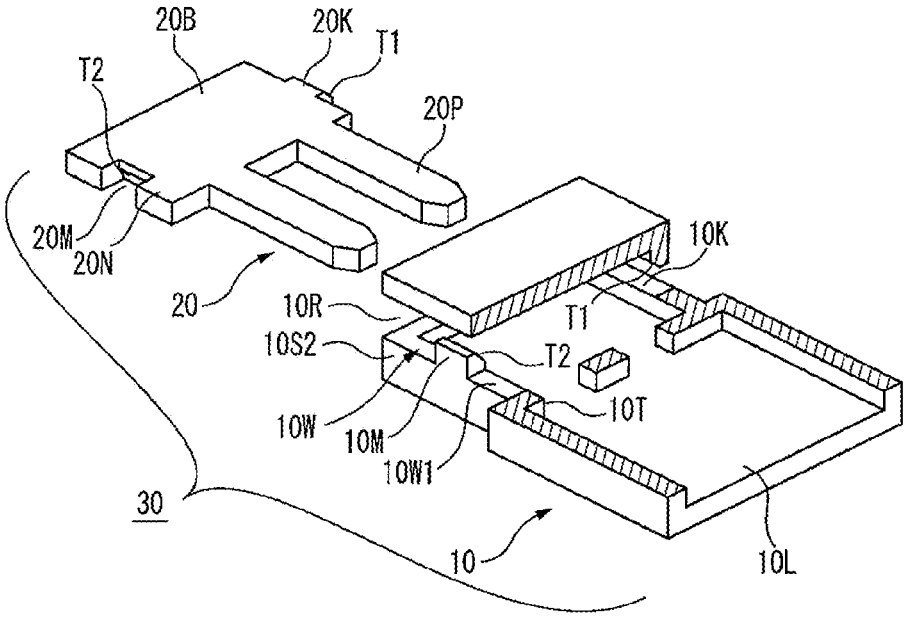

(2) In a side (part) of the rectangular base part 20B opposed to the tapered protrusion 10M of the opposite side wall 10S2 (see FIG. 2) in a position where the terminal 20 is held in the connector housing 10, the tapered engaging recessed part 20M (see FIG. 1 and FIG. 3(B)) is formed with which the tapered protrusion 10M of the connector housing 10 is engaged to enter.

<Tapered Protrusion 20K According to the Present Exemplary Embodiment>

In FIG. 1 and FIG. 3, the tapered protrusion 20K is a protrusion with such a size that the tapered protrusion 20K may enter the rectangular tapered hole 10K formed in the connector housing 10 without an excessive insufficiency and likewise has a substantially semi-circular arc shaped protruding taper T1 formed in a part opposed to the substantially semi-circular arc shaped protruding taper T1 formed in the rectangular tapered hole 10K.

<Tapered Engaging Recessed Part 20M According to the Present Exemplary Embodiment>

In FIG. 1, FIG. 3(A) and FIG. 3(B), the tapered engaging recessed part 20M is a recessed part with such a size that the tapered protrusion 10M formed in the connector housing 10 may enter without an excessive insufficiency and likewise has a substantially semi-circular arc shaped protruding taper T2 formed in a part opposed to the substantially semi-circular arc shaped protruding taper T2 formed in the tapered protrusion M10.

<Procedure for Assembling Terminal 20 to Connector Housing 10>

A procedure will be described for assembling the terminal 20 according to the present exemplary embodiment to the connector housing 10 according to the present exemplary embodiment.

Figure 4A:
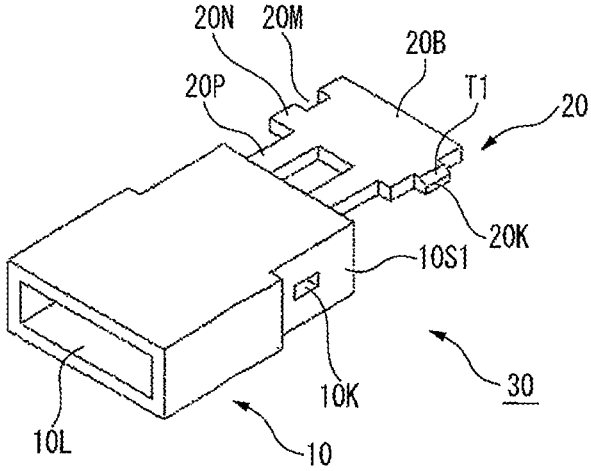
FIG. 4(A) is a perspective view of the slip-out preventing connector under a state that an insertion of the terminal to the connector housing is started.

(1) Initially, the two male terminals 20P of the terminal 20 are inserted into the inner space of the connector housing 10 from the rear surface opening 10R (see FIG. 2). FIG. 4(A) shows this state.

Figure 4B:
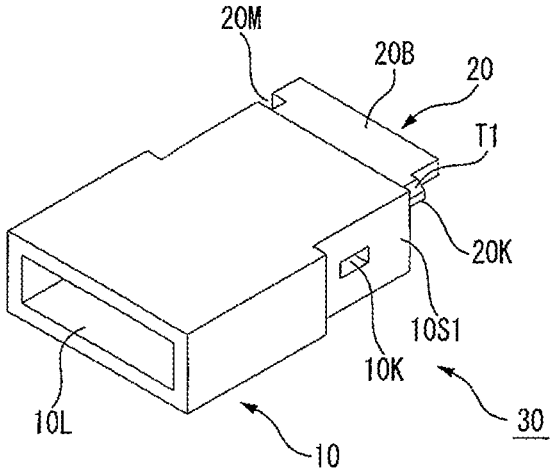
FIG. 4(B) is a perspective view of the slip-out preventing connector under a state that the terminal is halfway inserted.
Figure 4C:
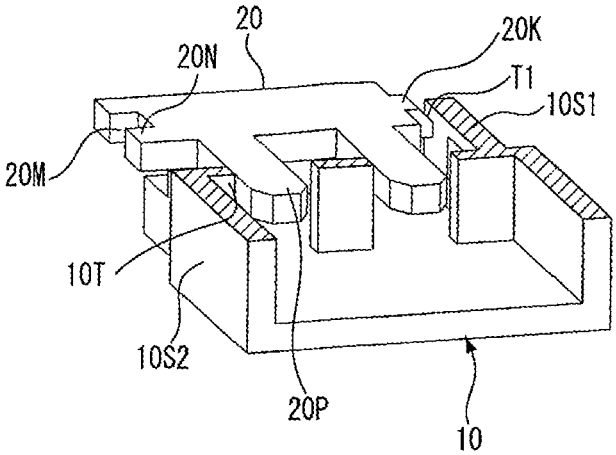
FIG. 4(C) is a perspective view of the slip-out preventing connector in horizontal section showing a side surface opposite to that of the slip-out preventing connector shown in FIG. 4(A) and FIG. 4(B) in which the insertion of the terminal further advances.

(2) Further, an insertion is continued. FIG. 4(B) shows this state. The tapered protrusion 20K and the tapered engaging recessed part 20M are not yet engaged with mates of engaging parts of the connector housing 10. The male terminals 20P of the terminal 20 come into contact with the tab side 10T formed to protrude in the connector housing 10. Further, the tapered protrusion 20K of the terminal 20 comes into contact with an inner wall of the one side wall 10S1, so that the terminal 20 is regulated and inserted.

Figure 5A:
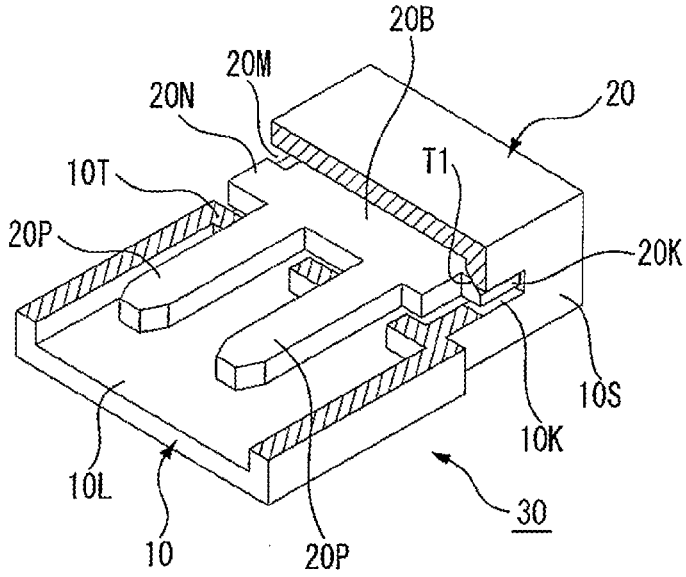
FIG. 5(A) is a partly broken perspective view of the slip-out preventing connector immediately before the terminal is fixed to the connector housing.
Figure 5B:
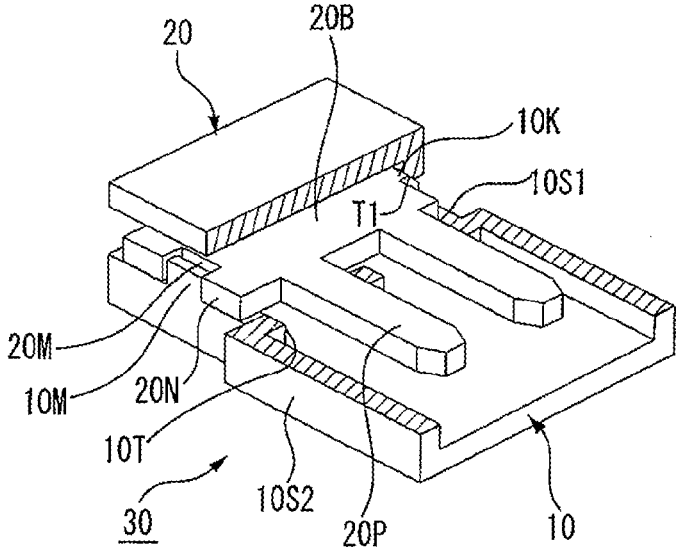
FIG. 5(B) is a partly broken perspective view of the slip-out preventing connector in which the terminal is fixed to the connector housing.
Figure 6A:
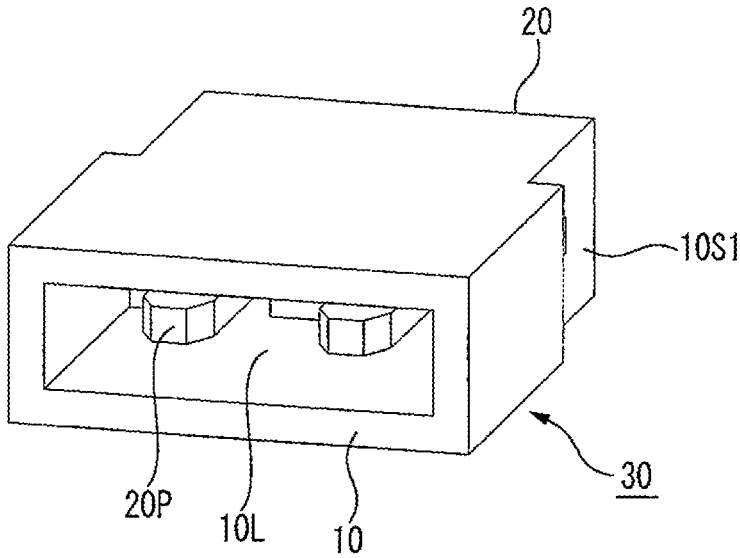
FIG. 6(A) is a perspective view of the slip-out preventing connector in which the terminal is fixed to the connector housing.
Figure 6B:
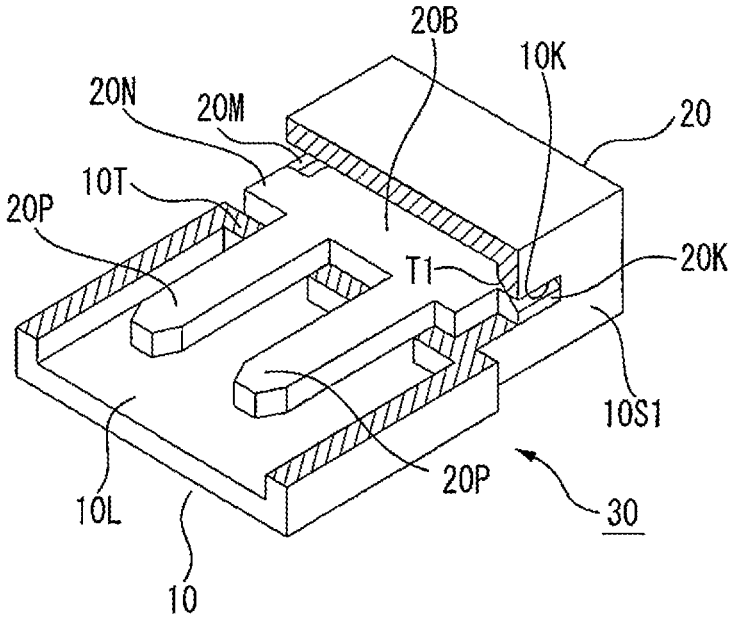
FIG. 6(B) is a partly broken perspective view showing a side surface opposite to that of the slip-out preventing connector shown in FIG. 5(B).
Figure 7A:
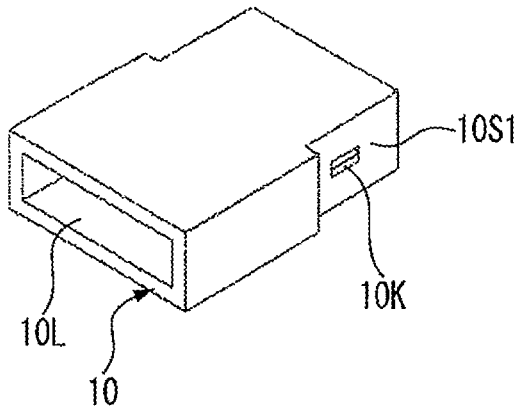
FIG. 7(A) is a perspective view showing the front side of the connector housing to which the terminal is fixed.
Figure 7B:
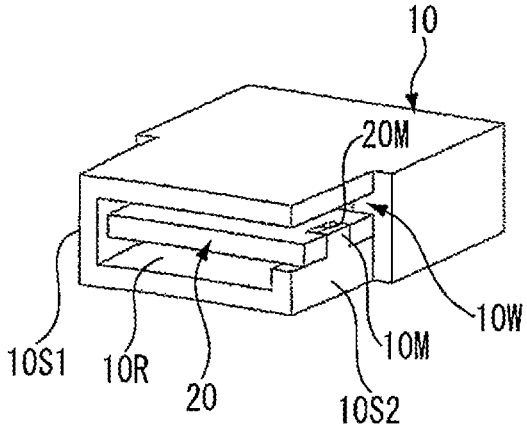
[FIG. 7(B)] is a perspective view showing an opposite side of the connector housing to which the terminal is fixed.
Figure 8A:
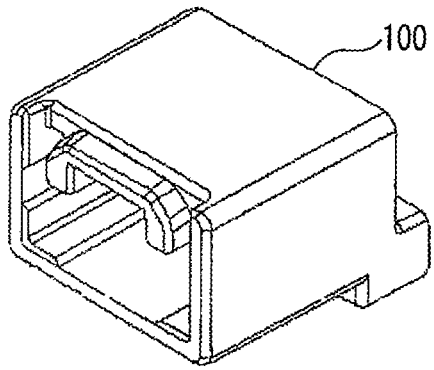
FIG. 8(A) is a perspective view of a connector housing in a usual connector.
Figure 8B:
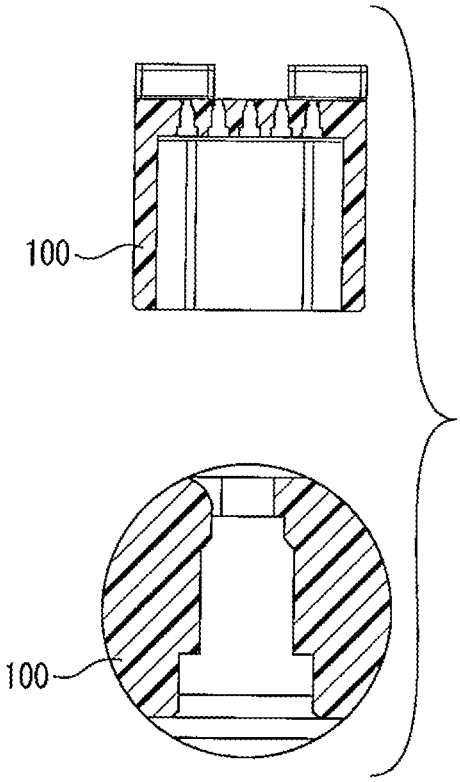
FIG. 8(B) is a horizontally sectional view of FIG. 8(A).
Figure 8C:
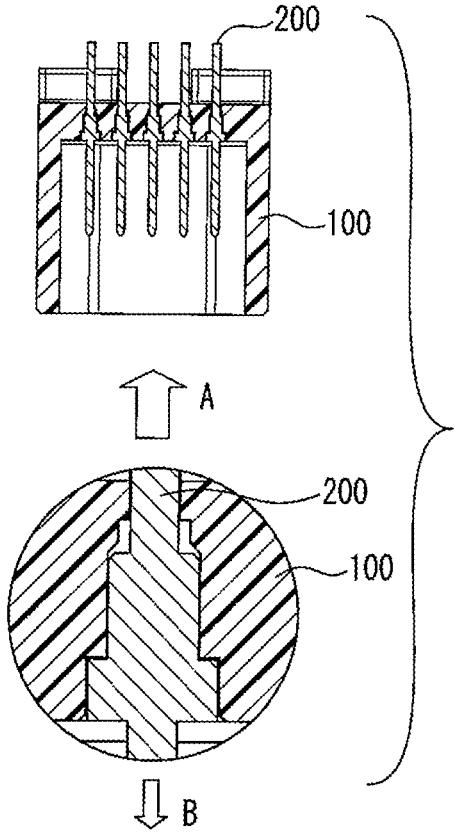
FIG. 8(C) is a horizontally sectional view of a state that a terminal is inserted.

(3) Further, when the insertion is continued, a crossbar 20N (see FIG. 1) which forms the tapered engaging recessed part 20M provided in the base part 20B of the terminal 20 in a front part of an inserting direction collides with the tapered protrusion 10M formed in the connector housing 10. Thus, when the base part 20B of the terminal 20 is raised upward so that the crossbar 20N may get over the tapered protrusion 10M, the crossbar 20N gets over the tapered protrusion 10M. Thus, the tapered engaging recessed part 20M is opposed to the tapered protrusion 10M. At this time, in the one side wall 10S1 of the connector housing 10, the tapered protrusion 20K is opposed to the tapered hole 10K at the same time. FIG. 5(A) shows this state.

(4) When the tapered engaging recessed part 20M reaches a position where the tapered engaging recessed part 20M is opposed to the tapered protrusion 10M, the protruding taper T2 of the tapered engaging recessed part 20M located in an upper part slides downward on the protruding taper T2 of the tapered protrusion 10M located in a lower part into the connector housing 10 in the inserting direction and at right angles to the inserting direction. Thus, the tapered engaging recessed part 20M is engaged with the tapered protrusion 10M.

At the same time, the protruding taper T1 of the tapered protrusion 20K in the one side wall 10S1 side also passes through (slides) below the protruding taper T1 of the tapered hole 10K of the connector housing 10 so as to slide outside the connector housing 10 at right angles to the inserting direction. Thus, the tapered protrusion 20K is engaged with the tapered hole 10K. FIG. 5(B), FIG. 6(A) and FIG. 6(B) and FIG. 7 show this state.

Under this state, since the terminal 20 and the connector housing 10 are provided with sufficient sheared surfaces, the terminal and the connector housing are not disengaged from each other by a tension of a female connector housing or an insertion of a female terminal.

<Method for Releasing Holding State>

When the terminal 20 is desired to be pulled out (desired to release a holding state) from the connector housing 10, a jig is inserted into the tapered hole 10K to push the terminal 20 so as to raise the terminal 20. Thus, the terminal 20 gets on the tapers T1 and T2 in an inner part to release the held state, so that the terminal can be easily pulled out.

SUMMARY

As described above, according to the present exemplary embodiment, in the one side of the base part of the terminal, the tapered protrusion is formed which enters the tapered hole in the side wall of the connector housing. In the opposite side of the base part of the terminal, the tapered engaging recessed part is formed which is engaged with the tapered protrusion in the opposite side wall of the connector housing. Thus, since the terminal and the connector housing are provided with the sufficient sheared surfaces, the terminal and the connector housing are not disengaged from each other by the tension of the female connector housing or the insertion of the female terminal.

Further, when the terminal is pulled out form the connector housing, the jig is inserted into the tapered hole to push the terminal so as be raised. Thus, the terminal gets on the inner tapers to release the held state, so that the terminal can be easily pulled out. As described above, even in the connector of a type that the terminal is inserted from the opposite side to the insert hole to which the mate side connector terminal is inserted, since the terminal cannot be pulled out, a holding force can be improved. Further, in overhauling, since the connector can be simply overhauled by using the jig, an overhauling property can be improved.

The above-described exemplary embodiment merely shows a representative form of the present invention and the present invention is not limited to the exemplary embodiment. Namely, the present invention may be variously modified and embodied within a range that does not deviate from the gist of the present invention.

According to the slip-out preventing connector of the present invention, even in the connector of a type that the terminal is inserted into the connector housing from the opposite side to the insert hole to which the mate side connector terminal is inserted, the holding force of the terminal can be improved and the overhauling property can be improved.

What is claimed is:

1. A slip-out preventing connector, comprising:

a terminal; and a connector housing having an insert hole to which a mate side connector terminal, which is separate from the terminal, is inserted and a rear surface opening as a terminal insert hole to which the terminal is inserted, the terminal being insertable from the rear surface opening and held in the connector housing; wherein:

in the connector housing, a side wall opening is formed so as to be continuous to an intermediate part in an upper half of a one side wall of the connector housing from the rear surface opening, and a tapered protrusion is provided so as to stand upward from a lower side opening end face of the side wall opening;

the terminal defines a tapered engaging recessed part that is configured to allow entry of the tapered protrusion of the connector housing, the tapered engaging recessed part being disposed at a location of the terminal that opposes the tapered protrusion when the terminal is held by the connector housing;

the connector housing defines a tapered hole in another side wall of the connector housing that is opposite to the one side wall;

in a part of the terminal opposed to the tapered hole of the other side wall at a position where the terminal is held in the connector housing, another tapered protrusion is formed so as to enter in the tapered hole; and the terminal as a whole, is slidable in a direction at right angles to an inserting direction of the terminal due to an operation of the tapered protrusion of the connector housing, the tapered engaging recessed part, the another tapered protrusion of the terminal, and the tapered hole, resulting in the terminal being held in the connector housing.

2. The slip-out preventing connector according to claim 1, wherein in the connector housing, a guide protruding part which extends in the inner space of the connector housing is formed from the one side wall having the side wall opening formed;

the guide protruding part comes into contact with a pin of the terminal, and the tapered protrusion of the terminal comes into contact with an inner surface of the other side wall of the connector housing, so that the terminal is regulated and inserted.

3. The slip-out preventing connector according to claim 1, wherein the terminal is configured to be sufficiently rigid so that upon a slidable displacement of the terminal, the tapered engaging recessed part and the other tapered protrusion are substantially equally displaced in both direction and magnitude.

4. The slip-out preventing connector according to claim 1, wherein the connector housing is configured to be substantially asymmetrical in structure.

5. The slip-out preventing connector according to claim 1, wherein the tapered protrusion of the connector housing is located on a lower side opening end face of the side wall opening of the connector housing.

6. The slip-out preventing connector according to claim 5, wherein the tapered protrusion of the connector housing is configured to enter the tapered engaging recessed part of the terminal to facilitate sliding of the terminal in a direction at right angles to an insertion direction of the terminal.

* * * * *